US009717961B2

(12) United States Patent
Cameron

(10) Patent No.: US 9,717,961 B2
(45) Date of Patent: Aug. 1, 2017

(54) PUTTER WITH INTEGRAL SIGHTLINE AND SOLE PLATE

(71) Applicant: Acushnet Company, Fairhaven, MA (US)

(72) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 448 days.

(21) Appl. No.: 14/253,041

(22) Filed: Apr. 15, 2014

(65) Prior Publication Data

US 2015/0080148 A1 Mar. 19, 2015

Related U.S. Application Data

(63) Continuation-in-part of application No. 14/031,976, filed on Sep. 19, 2013, now Pat. No. 9,227,115, and a continuation-in-part of application No. 29/487,233, filed on Apr. 7, 2014, now Pat. No. Des. 730,464.

(51) Int. Cl.
*A63B 53/04* (2015.01)

(52) U.S. Cl.
CPC ..... *A63B 53/0487* (2013.01); *A63B 53/04* (2013.01); *A63B 2053/0408* (2013.01); *A63B 2053/0441* (2013.01); *A63B 2053/0491* (2013.01)

(58) Field of Classification Search
USPC ..... 473/251–255, 250, 324–350
See application file for complete search history.

(56) References Cited

U.S. PATENT DOCUMENTS

| | | | | | |
|---|---|---|---|---|---|
| 1,618,638 | A | * | 2/1927 | Coles | A63B 53/06 473/282 |
| D222,280 | S | * | 10/1971 | Cook | 473/340 |
| 3,841,640 | A | | 10/1974 | Gaulocher | |
| 3,880,430 | A | * | 4/1975 | McCabe | A63B 69/3685 473/253 |
| D235,668 | S | | 7/1975 | Swash | |
| 3,931,975 | A | * | 1/1976 | Cook | A63B 53/0487 473/252 |
| 3,954,270 | A | * | 5/1976 | Cook | A63B 53/0487 473/252 |
| 3,966,210 | A | * | 6/1976 | Rozmus | A63B 53/0487 473/341 |
| 4,002,343 | A | | 1/1977 | Eckert | |

(Continued)

FOREIGN PATENT DOCUMENTS

| | | |
|---|---|---|
| JP | 3052104 U | 6/1998 |
| JP | 1189981 A | 4/1999 |

(Continued)

OTHER PUBLICATIONS

U.S. Appl. No. 14/031,976, filed Sep. 19, 2013, Don T. Cameron.

(Continued)

*Primary Examiner* — Alvin Hunter

(57) ABSTRACT

A putter having a body with a striking surface, an upper surface that is visible to player when in the address position and a sole plate that is coupled to a bottom surface of the body. The upper surface includes at least one aperture and the sole plate includes a sightline projection that extends into the aperture to form a sightline on the putter that is visible to the player.

7 Claims, 9 Drawing Sheets

(56) References Cited

U.S. PATENT DOCUMENTS 4,113,249 A * 9/1978 Beery ..... A63B 53/0487 473/329
4,128,244 A * 12/1978 Duclos ..... A63B 53/0487 473/242
4,136,877 A * 1/1979 Antonious ..... A63B 53/0487 473/254
4,140,318 A * 2/1979 Izett ..... A63B 53/007 473/313
4,163,554 A * 8/1979 Bernhardt ..... A63B 53/007 473/255
4,227,694 A * 10/1980 Drake ..... A63B 53/007 473/255
4,265,451 A * 5/1981 Bernhardt ..... A63B 53/007 473/313
4,411,429 A * 10/1983 Drew ..... A63B 53/007 473/313
4,458,900 A * 7/1984 Antonious ..... A63B 53/0487 473/254
4,712,797 A 12/1987 Kovalchek
4,722,528 A * 2/1988 Tsao ..... A63B 53/0487 473/254
4,934,702 A 6/1990 Serizawa
5,351,963 A * 10/1994 Baek ..... A63B 53/0487 473/241
5,407,194 A 4/1995 Snow
5,417,429 A 5/1995 Strand
5,464,215 A * 11/1995 Koehler ..... A63B 53/0487 473/341
5,464,218 A * 11/1995 Schmidt ..... A63B 53/0487 473/341
5,470,070 A * 11/1995 Bendo ..... A63B 53/0487 473/252
5,494,282 A 2/1996 Pranio
5,501,453 A 3/1996 Hurst
5,628,694 A 5/1997 O'Connor, Jr.
5,630,765 A * 5/1997 Moore ..... A63B 53/0487 473/252
5,683,307 A * 11/1997 Rife ..... A63B 53/0487 473/313
5,749,791 A 5/1998 Passeri, Jr.
5,816,930 A * 10/1998 Brown ..... A63B 69/3685 473/254
5,820,481 A 10/1998 Raudman
5,911,638 A 6/1999 Parente
5,913,731 A 6/1999 Westerman
5,921,868 A * 7/1999 DiMartino ..... A63B 69/3685 473/252
6,048,275 A 4/2000 Gedeon
6,062,986 A * 5/2000 Kaise ..... A63B 53/0487 473/242
6,080,070 A 6/2000 Whitley
6,117,020 A * 9/2000 Currie ..... A63B 69/3614 473/220
6,261,190 B1 7/2001 Ashcraft
6,270,422 B1 * 8/2001 Fisher ..... A63B 53/0487 473/223
6,319,146 B1 11/2001 Mills
6,350,208 B1 2/2002 Ford
6,558,268 B2 5/2003 Tindale
6,796,911 B2 9/2004 Grace
6,837,801 B1 1/2005 Souza et al.
6,878,072 B1 4/2005 Henry
6,902,496 B2 * 6/2005 Solheim ..... A63B 53/0487 473/341
6,926,615 B1 8/2005 Souza et al.
6,958,019 B2 10/2005 Rohrer
6,960,140 B2 11/2005 Solheim et al.
7,004,849 B2 2/2006 Cameron
D521,582 S 5/2006 Souza et al.
7,048,646 B2 5/2006 Yamanaka et al.
7,052,409 B2 * 5/2006 Goldsmith ..... A63B 53/0487 473/242
7,077,758 B2 7/2006 Rohrer
7,147,569 B2 * 12/2006 Tang ..... A63B 53/0487 473/249
7,163,469 B2 1/2007 Bonneau
7,166,039 B2 1/2007 Hettinger et al.
D540,897 S 4/2007 Oldknow et al.
7,235,021 B2 6/2007 Solheim et al.
D564,606 S 3/2008 Oldknow et al.
7,344,451 B2 3/2008 Tang et al.
7,371,184 B2 5/2008 Tao
7,374,497 B2 5/2008 Brown
7,407,443 B2 8/2008 Franklin et al.
7,438,648 B2 10/2008 Wahl et al.
7,455,599 B2 11/2008 Jones
7,491,131 B2 2/2009 Vinton
7,578,752 B1 8/2009 Flores
7,588,499 B2 9/2009 Tateno
7,611,419 B2 11/2009 O'Neill
D607,950 S 1/2010 Souza et al.
7,789,764 B2 * 9/2010 Wilson ..... A63B 53/0487 473/220
7,815,515 B1 10/2010 Hunt
7,824,275 B2 11/2010 Sussich
7,833,108 B2 11/2010 Hosowich
7,922,596 B2 4/2011 Vanderbilt et al.
7,959,519 B2 * 6/2011 Zielke ..... A63B 53/0487 273/DIG. 14
8,100,779 B2 1/2012 Solheim et al.
8,128,505 B2 * 3/2012 Tryner ..... A63B 53/0487 473/242
8,308,583 B2 * 11/2012 Morris ..... A63B 53/0487 473/335
8,328,654 B2 12/2012 Demkowski et al.
8,371,958 B2 2/2013 Treadwell
8,382,605 B2 * 2/2013 Treadwell ..... A63B 53/0487 473/251
8,480,504 B2 7/2013 Hilton et al.
8,932,144 B2 * 1/2015 Simizu ..... A63B 53/0487 473/238
D730,464 S 5/2015 Cameron
9,248,352 B1 2/2016 Patten
2004/0209702 A1 10/2004 Charron
2005/0137027 A1 6/2005 Thomas
2006/0258475 A1 11/2006 Lee
2007/0105652 A1 5/2007 Beach
2007/0298904 A1 12/2007 Dworzan
2015/0080147 A1 3/2015 Cameron

FOREIGN PATENT DOCUMENTS

JP 2005518885 A 6/2005
JP 2006247320 A * 9/2006
JP 2006326216 A * 12/2006
JP 2007029648 A 8/2007
JP 2008132197 A 6/2008
JP 2010284434 A * 12/2010

OTHER PUBLICATIONS

U.S. Appl. No. 29/487,233, filed Apr. 7, 2014, Don T. Cameron.
U.S. Appl. No. 29/528,834, filed Jun. 1, 2015, Don T. Cameron.
U.S. Appl. No. 14/807,006, filed Jul. 23, 2015, Don T. Cameron.

* cited by examiner

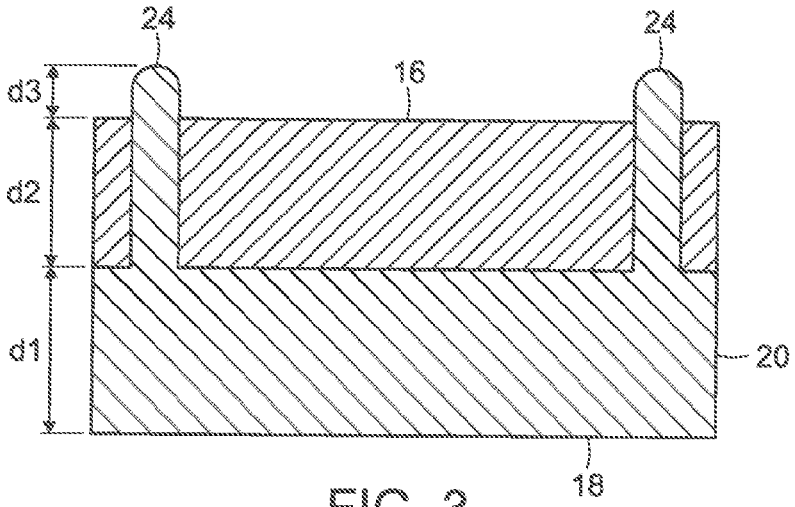
FIG. 3
FIG. 4
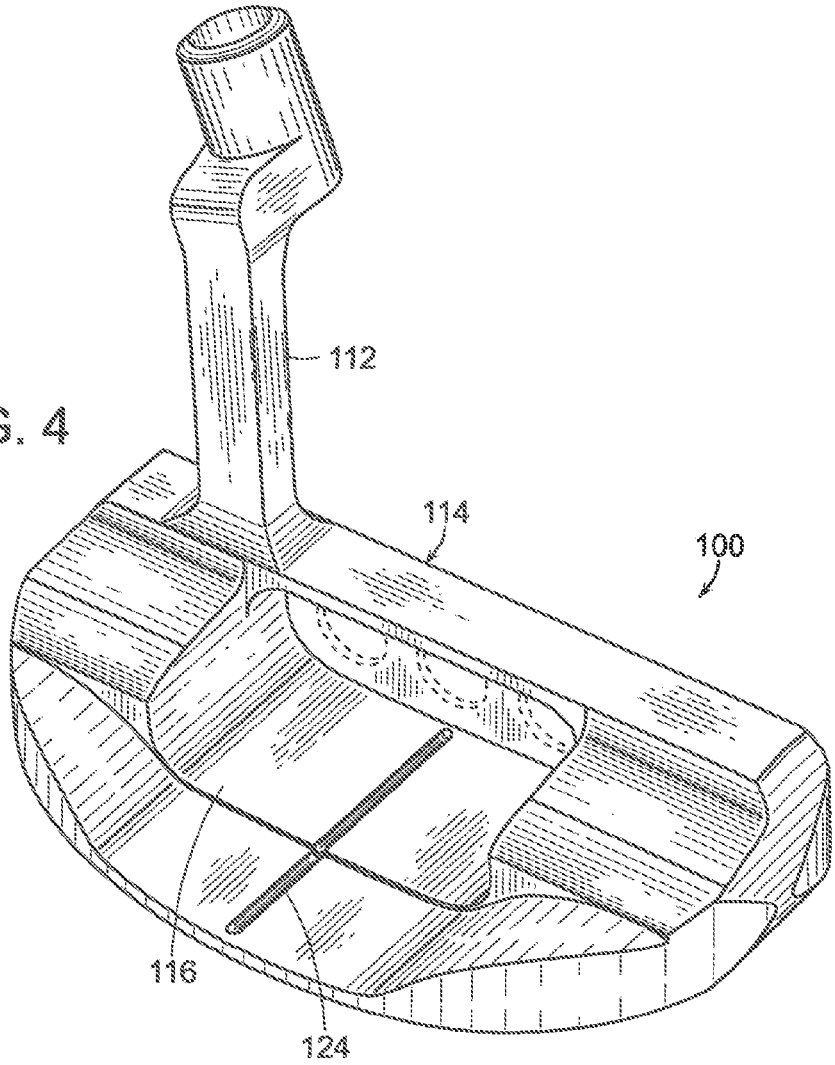

PUTTER WITH INTEGRAL SIGHTLINE AND SOLE PLATE

RELATED APPLICATIONS

The present application is a continuation-in-part of co-pending U.S. application Ser. No. 14/031,976, filed on Sep. 19, 2013 and a continuation-in-part of co-pending U.S. application Ser. No. 29/487,233, filed on Apr. 7, 2014, which are hereby incorporated by reference in their entirety.

FIELD OF THE INVENTION

The present invention relates to a golf club, and, more particularly, the present invention relates to a golf putter having a body and sightlines formed by a sole plate.

DESCRIPTION OF THE RELATED ART

Golf club heads come in many different forms and makes, such as metal-woods, irons (including wedges), utility- or hybrid- or specialty-type clubs, and putters. Each of these styles has a prescribed function and general construction. The present invention primarily relates to putters, which typically are used to strike a golf ball and impart a rolling path on the greens of a course.

There are many styles of putters, including blades, mallets, heel-toe weighted, and T-line putters. Different types of putters provide different advantages. For example, T-line putters typically have a body member extending rearward from the face. This may help the golfer visualize the intended line of the putt, and may provide improved mechanical attributes. Some putters that are heel-toe weighted are designed for maximum moment of inertia so that when the ball is struck on a location that is offset from the center of the face, the putter resists rotating.

Putters are also governed by the rules of golf set by the USGA. The rules include the heel-toe dimension, the front-to-back dimension, the neck length, the face angle, the lie angle and that the putter shall not be substantially different from the customary and traditional form.

SUMMARY OF THE INVENTION

The present invention is directed to a putter that is comprised of a body and a striking face. The body includes a hosel or heck that is coupled to a shaft and grip. The body also includes an upper surface behind the striking surface that is visible to player when in the putter is in the address position. A sole plate is coupled to the bottom surface of the body and can be used to form a portion of the putter with a different density and/or color. The body further comprises at least one aperture on the upper surface and the sole plate includes a sightline projection that extends into the aperture to form a sightline on the putter that is visible to the player in the address position. Preferably, the aperture and sightline projection extend along the upper surface in a direction that is substantially perpendicular to the striking face. In one embodiment, the aperture and the sightline projection are aligned such that an extension of the sightline projection would intersect the center of the striking face. In another embodiment, the putter is formed with a plurality of apertures that are substantially parallel to each other and spaced apart by about 0.5 inches to 2.0 inches and the sightline projections form parallel sightlines that are equally spaced about the center of the striking face.

In a preferred embodiment, the sightline projection from the sole plate extends through the aperture in the body by a distance that is between 0.01 inches and 0.5 inches. By extending the sightline projection above the upper surface of the body, the sightline projection may be used to ensure proper positioning of the eyes over the putter at address.

It is preferred that the body of the putter is formed of a first material such as stainless steel that has a first density of approximately 7 g/cc to 8 g/cc and that the sole plate is formed from a second material such as aluminum that has a second density of about 2.5 g/cc to 3 g/cc such that it is less than 80% of the first density. More preferably, the second density is less than 50% of the first density.

In another preferred embodiment, the putter is formed of a body made from aluminum. These putters are generally larger mallet type putters and would have a first density of about 2.5 g/cc to 3.0 g/cc. In these putters, the sole plate can be formed from a second material such as stainless steel that has a density that is greater than 120% of the body's density. The sole plate can be formed such that its density is greater than 200% of the body's density.

In yet another preferred embodiment of the present invention, the body of the putter can include two, spaced-apart apertures that are parallel to each other and perpendicular to the striking face with corresponding sightline projections. The putter can also preferably be formed with two perpendicular sightline projections, the first being perpendicular to the face and the second being parallel to the face. Preferably, the first and second sightline projections form a T-shaped sightline. The second sightline projection is preferably spaced from the face by a distance of equal to or greater than ½ the striking face length. Further, the first sightline projection is approximately equal to or longer than the second sightline projection.

In another preferred embodiment of the present invention, the sole plate is L-shaped and forms a portion of the striking face of the putter as well as the sole. Preferably, the L-shaped sole plate is coupled to the putter body through a plurality of fasteners on the sole of the putter and on the back face of the putter.

In another preferred embodiment of the present invention, the putter includes a face member defining a striking face and having a first, substantially vertical rear surface opposite said striking face, a second, substantially horizontal rear surface extending between the striking face and the first rear surface, a heel, and a toe. A body member is coupled to said first rear surface and extends rearward away from the striking face. The body member includes at least one hole there through on the upper surface thereof. A sole plate is coupled to body member at least on the bottom surface and includes a sightline projection extending therefrom and through the hole in the body member. The body member and the sightline projection are preferably different colors. For example, the body member can be formed to have a color selected from the group consisting of silver and black and the sole plate and the sightline projection can be formed red.

The present invention is also directed to a putter comprising a striking face member, an upper surface behind the striking face member that is visible to player when in the address position, and a sole plate that is coupled to a bottom surface of the body. In this embodiment, the body comprises at least one aperture on the upper surface and the sole plate includes a plurality of sightlines that are visible to the player in the address position through the aperture. Preferably, the body is comprised of a plurality of spaced apart body portions extending rearward from a back surface of the striking face member and the aperture extends between the spaced apart body portions. More preferably, the body includes an aperture in the upper surface between the body members and the sole plate includes at least two sightlines, a heel side sightline and a toe side sightline, that are spaced apart by about 0.5 inches to 2.0 inches.

Another embodiment of the putter according to the present invention is putter comprising a face member defining a striking face and having a toe side sightline and a heel side sightline and a bore for receiving a shaft. The shaft is configured to have a lower portion with a lower portion shaft axis and an upper portion configured to have an upper portion shaft axis. Preferably, the lower portion shaft axis extends in a forward direction from the upper surface and in a heelward direction from the upper surface and the upper portion shaft axis extends in a heelward direction. More preferably, the lower portion shaft axis extends in a forward direction from the upper surface at an angle of between 10 and 15 degrees from a vertical plane and in a heelward direction from the upper surface at an angle of between 2 and 5 degrees from a vertical plane. The shaft lower portion and the heel side sightline align when the putter is in the address position.

DESCRIPTION OF THE DRAWINGS

The present invention is described with reference to the accompanying drawings, in which like reference characters reference like elements, and wherein:

FIG. 3 shows a cross-sectional view of the putter of FIG. 1;

FIG. 4 shows a top perspective view of another putter of the present invention;

DETAILED DESCRIPTION OF THE INVENTION

Figure 1:
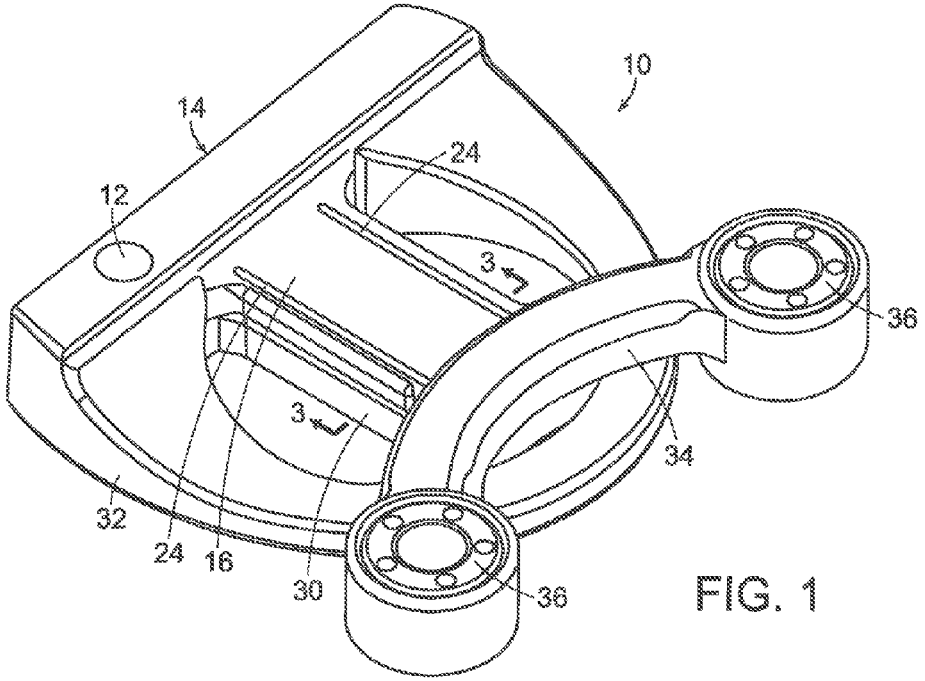
FIG. 1 shows a top perspective view of a putter of the present invention.
Figure 2:
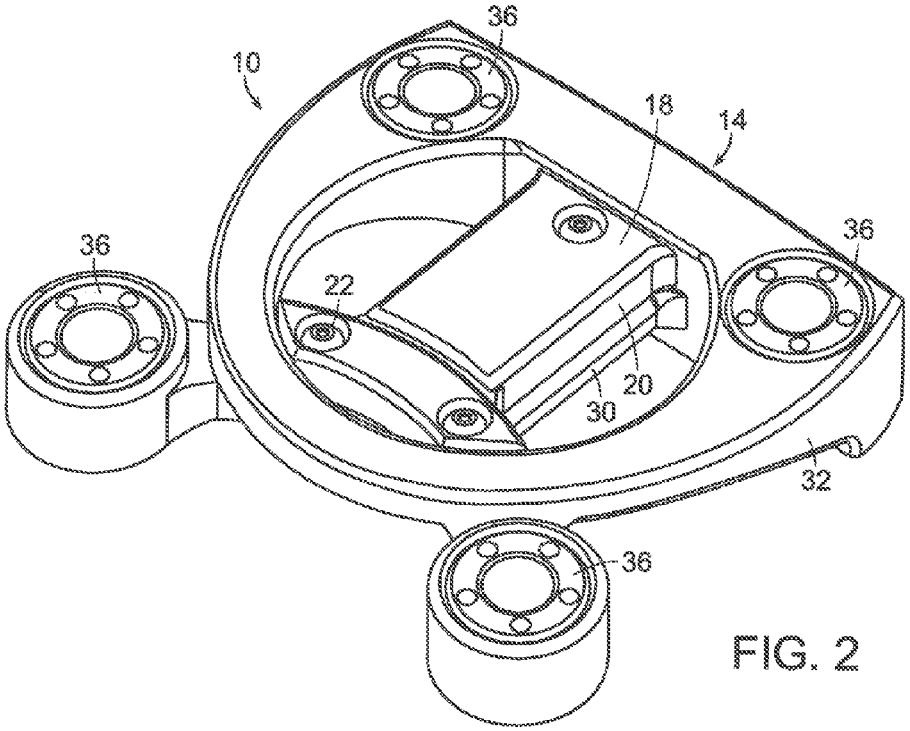
FIG. 2 shows a bottom perspective view of the putter of FIG. 1.

Referring to FIGS. 1-3, the present invention is directed to a putter 10. The putter includes a striking face portion 14 for impacting the golf ball during the putting stroke. The putter in this embodiment includes a hosel 12 that is coupled to a shaft and grip as is well known in the art. Extending rearward from the back surface of the striking face member is a body portion 16. In this embodiment, the body member 16 includes a central portion 30, a perimeter portion 32 and an extension portion 34.

The putter 10 also includes a sole plate member 20 that forms a portion of the bottom surface 18 of the putter. The sole plate member 20 is coupled to the body member 16 via a plurality of fasteners 22 that are located on the bottom surface 18. The putter also includes a plurality of weight members 36. The weight members 36 are preferably located near the heel and toe and at the front and back of the putter to increase the moment of inertia of the putter 10.

The putter 10 also includes a plurality of sightlines 24 to assist the player in lining up the given shot. The sightlines 24 are formed by a plurality of apertures in the body 16 and a plurality of sightline projections 24 extending from the sole plate 20, through the apertures and to the upper surface of the putter 10. As shown in FIG. 3, it is preferable that the sightline projections extend above the upper surface of the body 16 by a distance $d_3$ that is between 0.01 inch and 0.5 inch. The body 16 has a first thickness $d_2$ and the sole plate 20 has a thickness $d_1$. Preferably, the extension of the sightline projections $d_3$ is less that the thickness of the body $d_2$ and less than the thickness of the sole plate $d_1$. By having the sightline projections 24 extend above the upper surface of the body 16, the sightline projections can assist the player in confirming their proper address position. For example, markings such as indentations or paint can be located on the upper surface of the body 16 adjacent to the apertures such that the projections can obscure the marking from view when the player is not in the proper address position.

In this embodiment, the sightline projections 24 are parallel to each other and are positioned to extend perpendicular to the striking face. Preferably, the sightline projections are spaced apart by 0.5 inches to 2.0 inches and more preferably about 1.0 inch. In another preferred embodiment, the sightline projections 24 are spaced apart by about 1.6 inches to correspond to the width of a golf ball. The sightline projections 24 are preferably equally spaced about the center of the striking face, or impact location.

Figure 5:
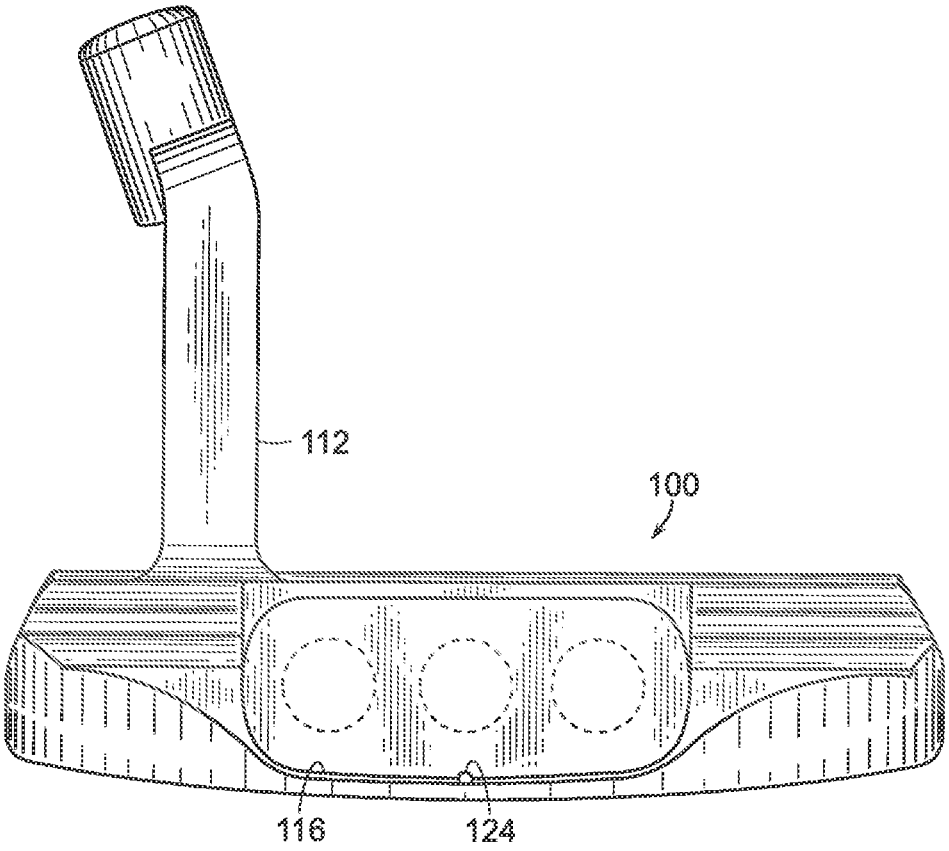
FIG. 5 shows a back view of the putter of FIG. 4.
Figure 6:
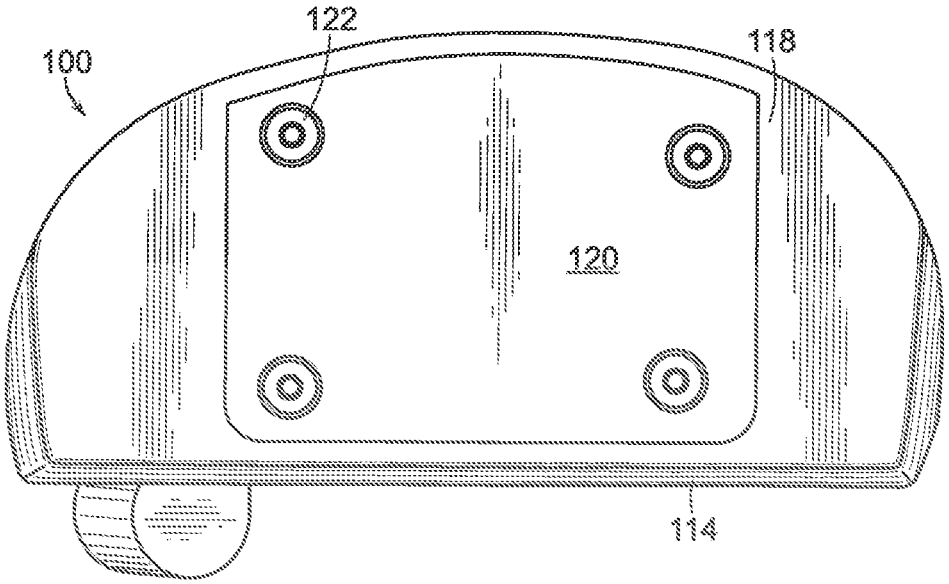
FIG. 6 shows a bottom view of the putter of FIG. 4.

Referring to FIGS. 4-6, a second embodiment of the present invention includes a putter head 100 that includes a neck 112 for coupling a shaft and grip. The putter also includes a strike face 114 for impacting the golf ball during the putting stroke. Extending rearward from the strike face 114 is an upper surface 116 that can be seen by the golfer in the address position. Also seen on the putter 100 is a sightline 124 that extends rearwardly from the center of the strike face 114 and perpendicular to the strike face 114.

As shown in more detail in FIG. 5, the sightline 124 preferably extends to the height of the upper surface 116 or above the upper surface 116. As with the previous embodiment, the sightline 124 is part of the sole plate 120. As shown in FIG. 6, the sole plate 120 is fixed to the bottom surface 118 of the putter 100 by a plurality of fasteners 122.

In a preferred embodiment, the upper surface 116 is preferably one color such as grey or black and the sightline 124 is a different, contrasting color such as red. In the most preferred embodiment, the putter upper surface is formed of steel and has a specific gravity of about 7 g/cc to 8 g/cc and the sole plate 120 and sightline 124 are formed of anodized aluminum having a specific gravity of about 2.5 g/cc to 3 g/cc and is red or other contrasting color. For example, if the upper surface 116 is black, the sightline 124 can be red, white, silver or other bright color. If the upper surface 116 is grey, the sightline 124 can be red, white, black or other contrasting color. In a preferred embodiment, a golfer can select a color of the sole plate 120 and sightline 124 in order to personalize their putter.

Figure 7:
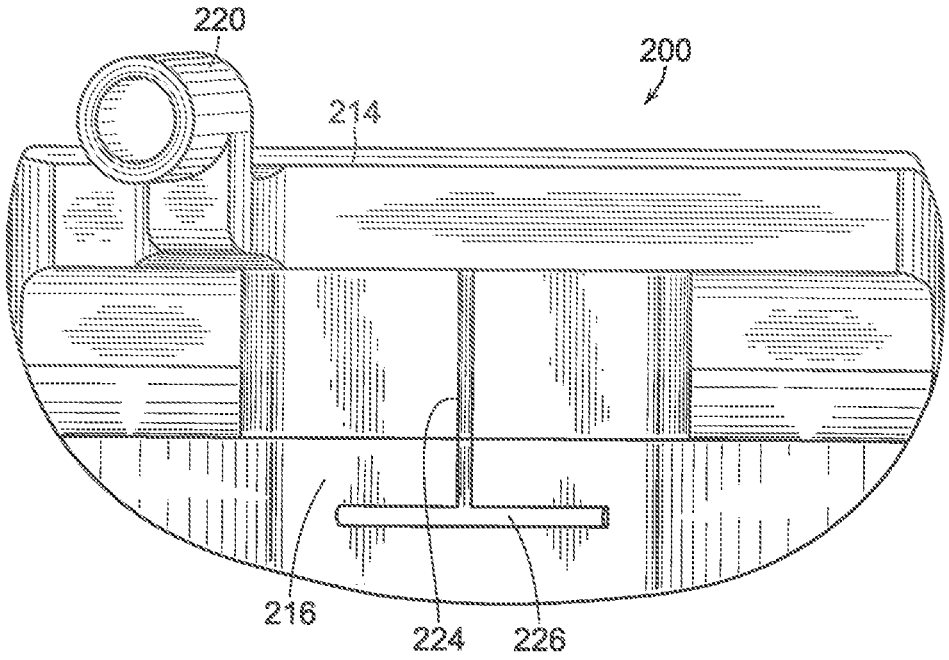
FIG. 7 shows top view of another embodiment of a putter of the present invention.

Referring to FIG. 7, the putter 200 includes a face 214 and a hosel 220. Extending back from the face 214 is an upper surface 216 that includes intersecting apertures with corresponding sightlines 224 and 226. The sightlines 224 and 226 are perpendicular to each other to form a T-shaped sightline, where the first portion 224 is perpendicular to the face 214 and the second portion 226 is parallel to the face 214. Preferably, the length of the second portion 226 is approximately ½ the blade length or greater. Further, the first portion 224 preferably extends from the center of the face 214.

Figure 8:
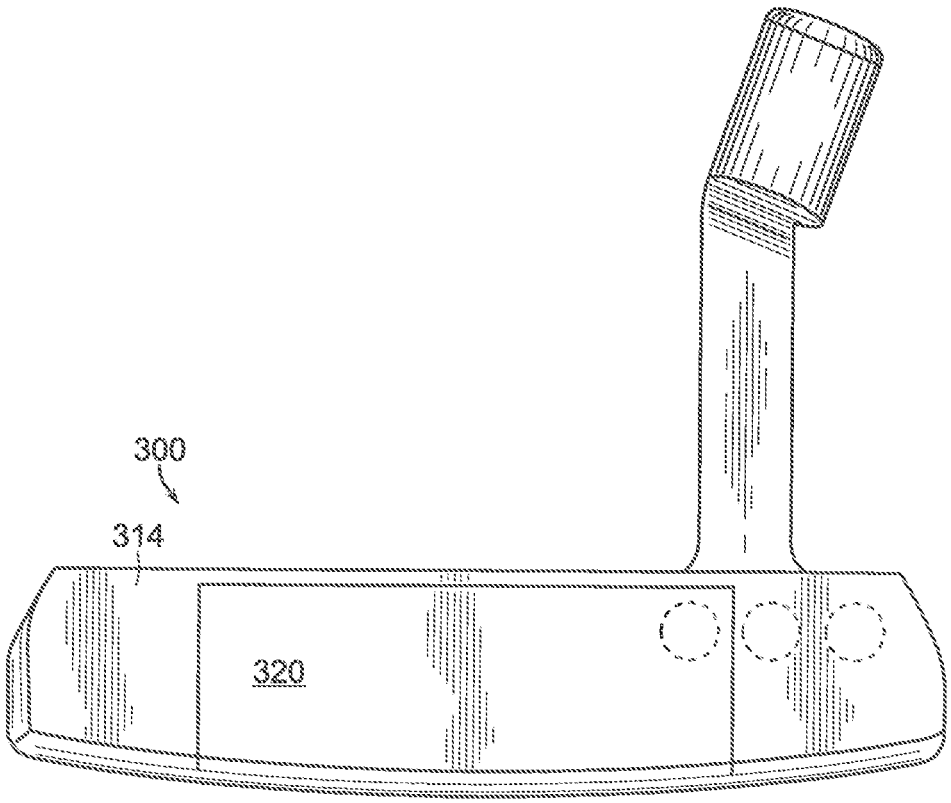
FIG. 8 shows a front view another embodiment of a putter of the present invention.
Figure 9:
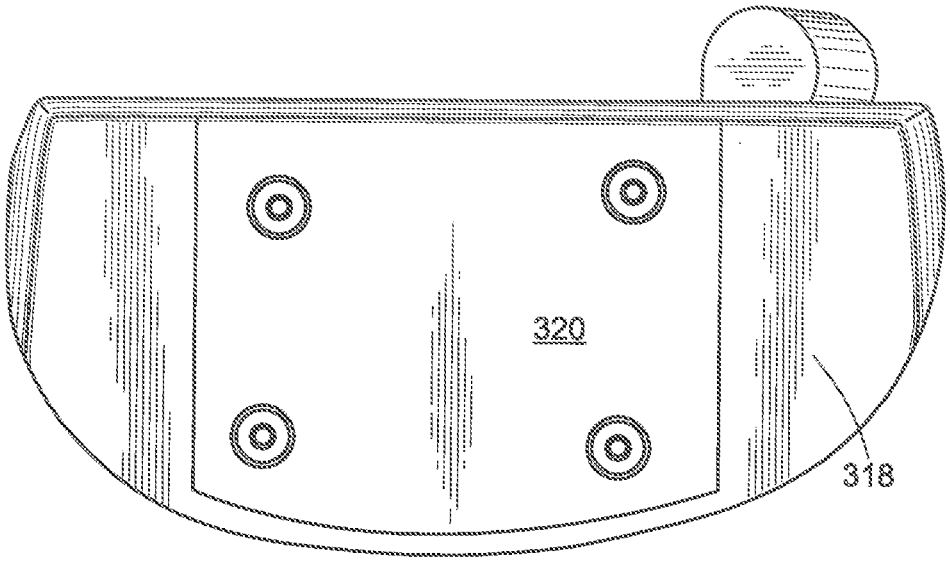
FIG. 9 shows a bottom view of the putter of FIG. 8.

Referring to FIGS. 8 and 9, another preferred embodiment of the present invention includes a putter 300. In this embodiment, the sole plate 320 forms a portion of the bottom surface 318 of the putter 300 as well as a portion of the striking face 314. In this embodiment, the face and sole plate can be formed of aluminum and weight members can be added under the sole plate or in the toe and heel areas to increase the club head's moment of inertia. Preferably, the weight members are formed of tungsten or other material having a specific gravity of about 14 g/cc or greater. As an example, the weight members can be formed to weigh 20 to 50 grams each.

Figure 10:
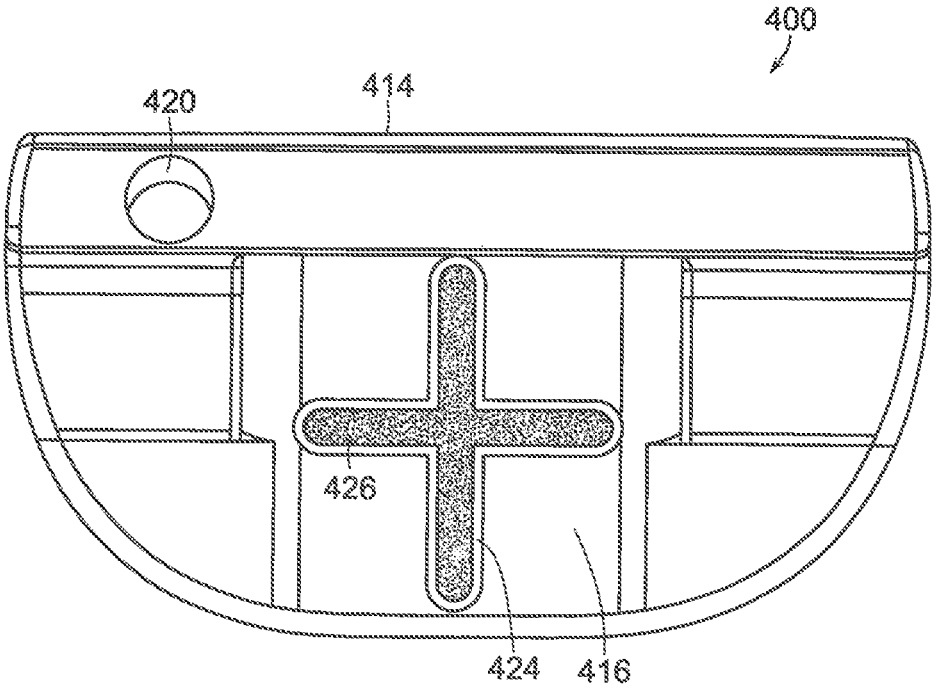
FIG. 10 shows a top view of another embodiment of a putter of the present invention.
Figure 11:
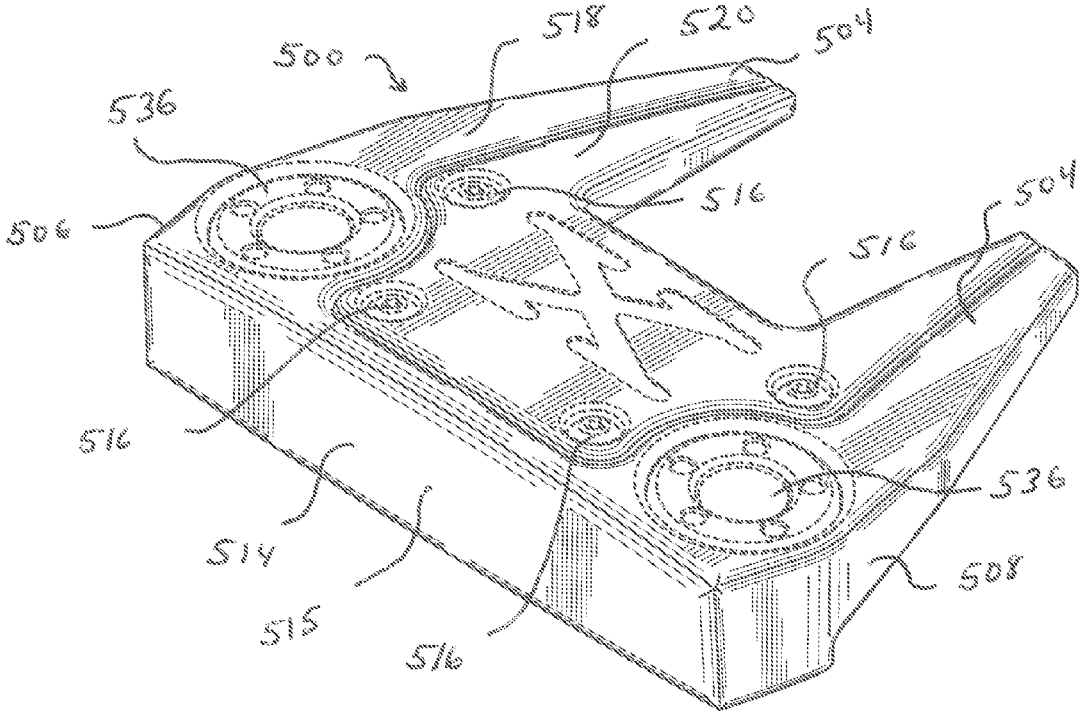
FIG. 11 shows a bottom perspective view of another embodiment of a putter of the present invention.

Referring to FIG. 10, another preferred embodiment of the present invention includes a putter 400 having a strike face 414. The putter includes sightlines 424 and 426 that are integral with the soleplate and extend through apertures in the upper surface 416. The plurality of sightlines 424 and 426 are perpendicular to the strike face 414 and parallel to the strike face 414, respectively. In this embodiment, the sightlines 424 and 426 together are cross-shaped. The hosel 420 is used to attach the putter 400 to a shaft and grip, not shown.

Referring to FIGS. 11-14, another preferred embodiment of the present invention includes a putter 500. In this embodiment, the sole plate 520 forms a portion of the bottom surface 518 of the putter 500. The putter includes a striking face portion 514 for impacting the golf ball during the putting stroke. Extending rearward from the back surface of the striking face member 514 is a plurality of spaced apart body portions 504.

In this embodiment, the sole plate 520 can be formed of aluminum or steel and weight members 536 can be added juxtaposed the sole plate 520 and the heel 506 and toe 508 portions. Preferably, the weight members are formed of tungsten or other material having a specific gravity of about 14 g/cc or greater. As an example, the weight members 536 can be formed to weigh 20 to 50 grams each. The sole plate member 520 is coupled to the putter 500 via a plurality of fasteners 516 that are located on the bottom surface 518. The weight members 536 are preferably located near the heel 506 and toe 508 and at the front of the putter near the face 514 equidistance form the face center 515 to increase the moment of inertia of the putter 500.

Figure 12:
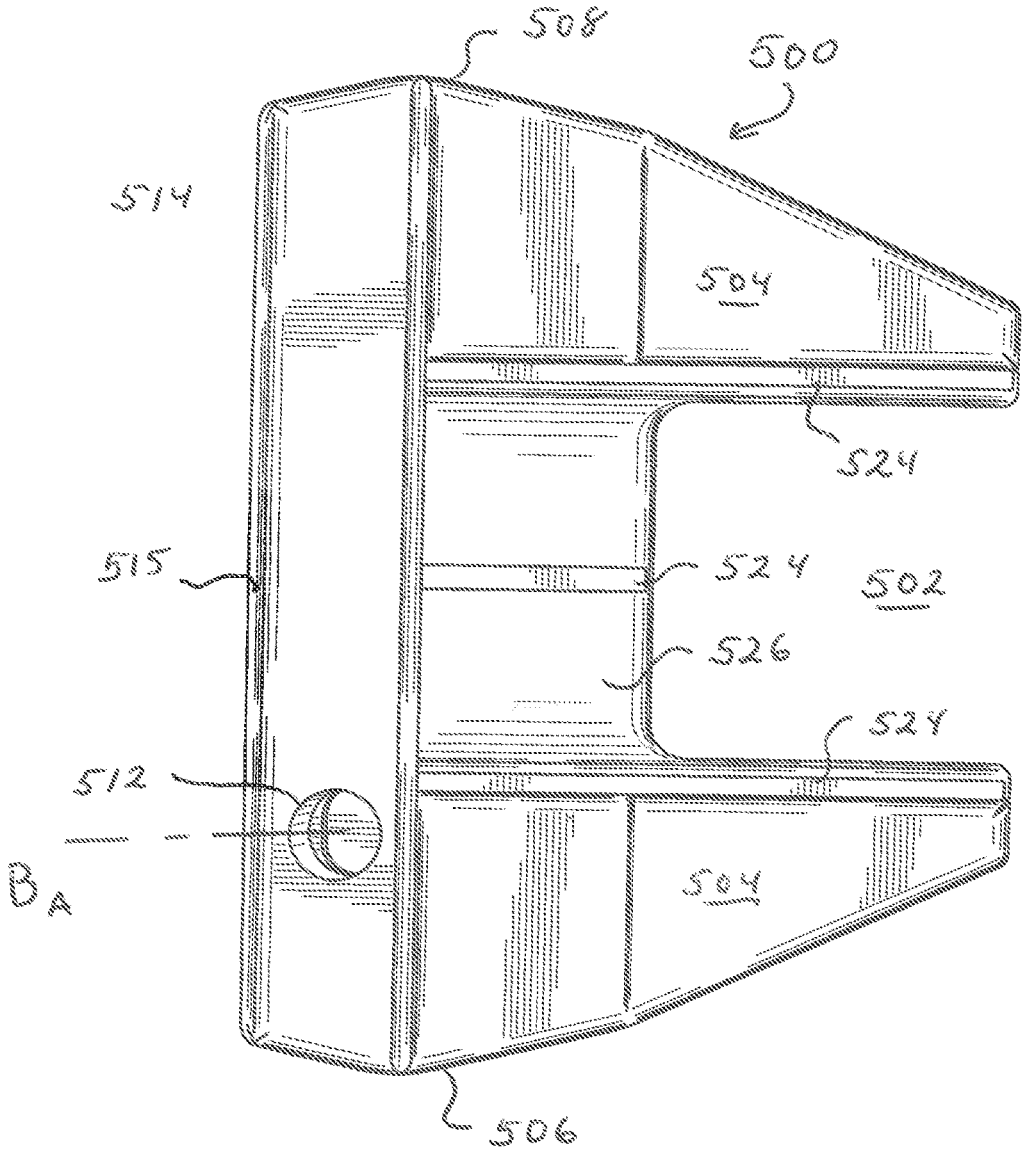
FIG. 12 shows a top view of the putter of FIG. 11.

Referring to FIG. 12, the putter 500 also includes a plurality of sightlines 524 to assist the player in lining up the given shot. The sightlines 524 are formed by aligning the sole plate 520 adjacent the spaced apart body portions 504 and in the aperture 502 created thereby. In this embodiment, it is preferable that the sightlines 524 remain below the upper surface of the body members 504 by a distance that is between 0.01 inch and 0.5 inch.

Figure 13:
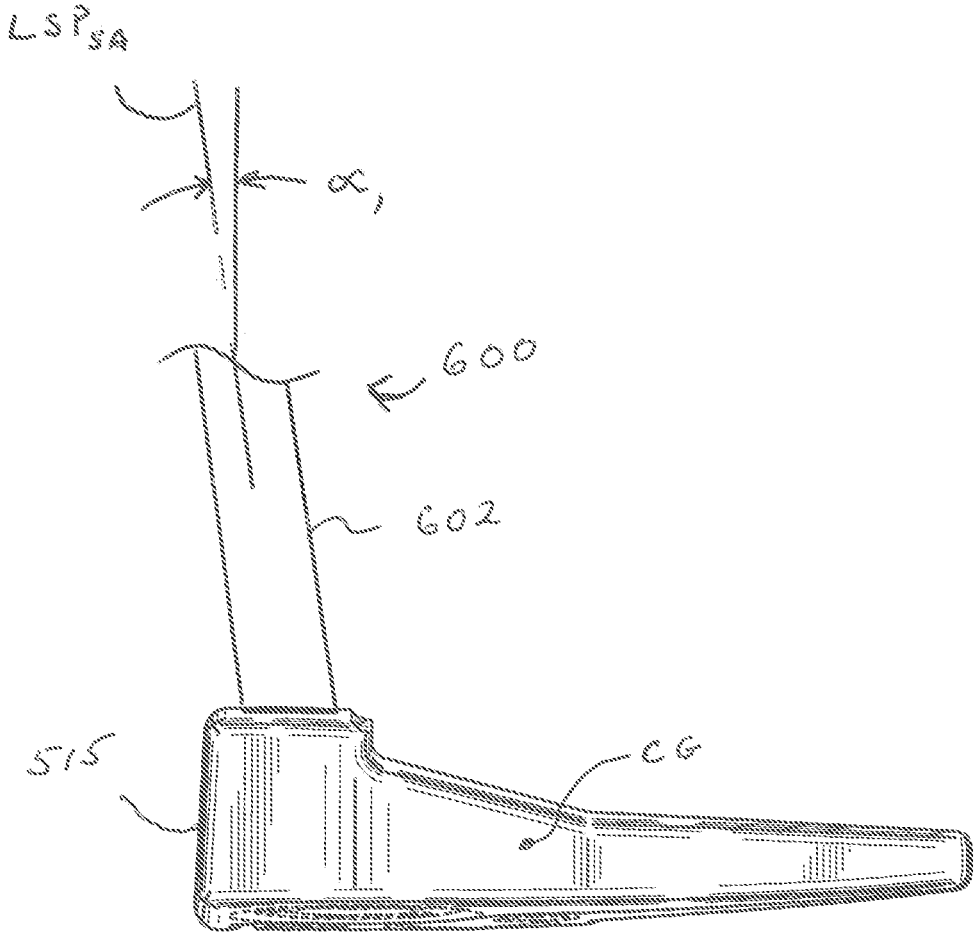
FIG. 13 shows a heel side view of the putter of FIG. 11.
Figure 14:
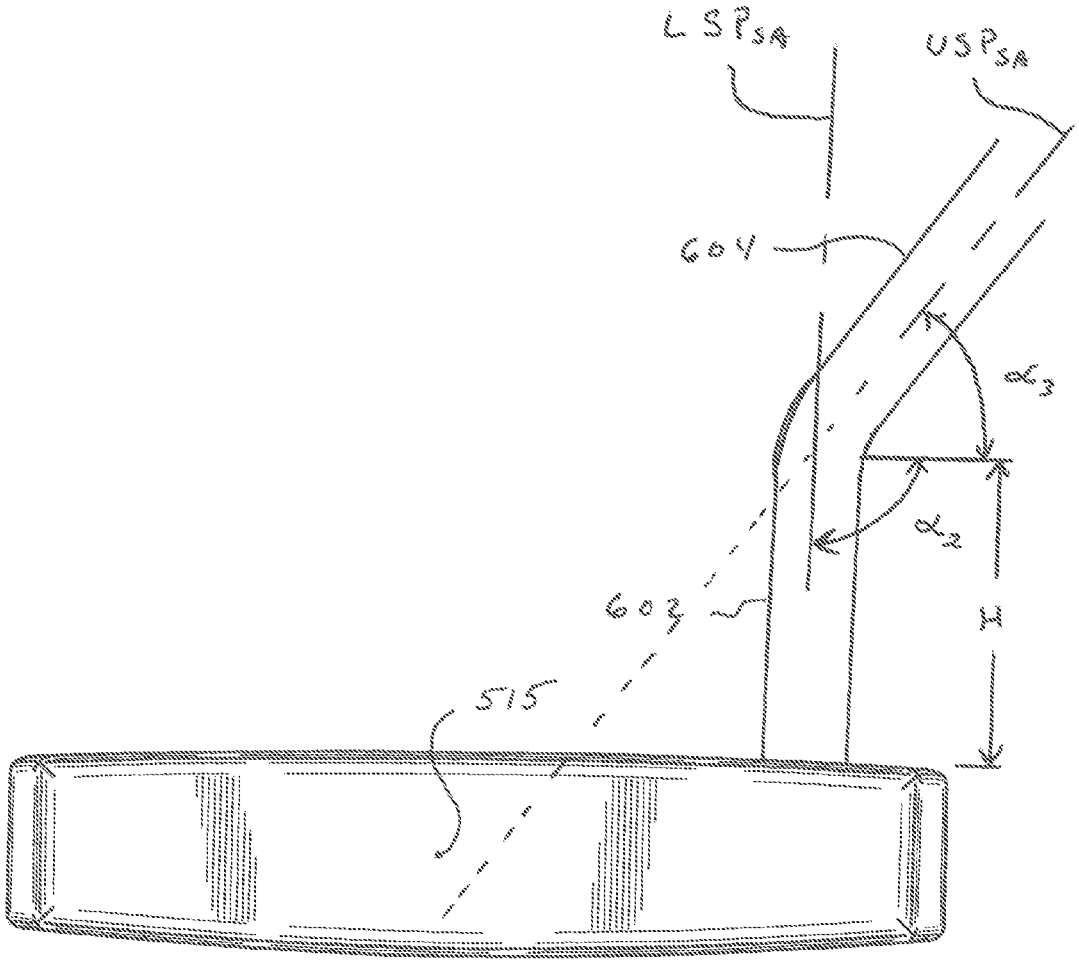
FIG. 14 shows a front view of the putter of FIG. 11.

The putter of this embodiment further includes a bore 512 having a bore axis $B_A$ that receives the lower portion of a shaft. Preferably, the edge of the bore 512 that is located furthest from the heel 506 is substantially aligned with the sightline 524 that is closest to the heel 506. In order to further improve alignment, the bore axis $B_A$ is formed, when extending into the putter from the upper surface, at an angle of between 10 and 15 degrees in the front-to-back direction and an angle of 2 to 5 degrees in the heel-to-toe direction. As shown in FIGS. 13 and 14, a shaft 600 is inserted into the bore 512. The shaft has a lower shaft portion 602 with a lower shaft portion shaft axis $LSP_{SA}$ and an upper shaft portion 604 with a upper shaft portion shaft axis $USP_{SA}$. The lower shaft portion shaft axis $LSP_{SA}$ is co-linear with the bore axis $B_A$ and, therefore, forms an angle $\alpha_1$ of between 10 and 15 degrees from the vertical plane in a back-to-front direction coming out of the putter to create offset and an angle $\alpha_2$ of 92 to 95 degrees from the horizontal plane such that the lower shaft portion leans back toward the heel in the heel-to-toe direction to align with players visual of the heel-side sightline 524. Most preferably, the lower shaft portion shaft axis $LSP_{SA}$ is co-linear with the bore axis $B_A$ and forms an angle $\alpha_1$ of 13 degrees from the vertical plane and an angle of 3 degrees from a vertical plane or an angle $\alpha_2$ of 93 degrees from the horizontal plane shown. The upper shaft portion shaft axis $USP_{SA}$ is formed to create the lie angle $\alpha_3$ of between 68 to 73 degrees from the horizontal as is known in the art. The height of the lower shaft portion H can be adjusted to be less than or equal to a height such that upper shaft portion shaft axis $USP_{SA}$ intersects an axis including the face center 515 and the center of gravity CG of the putter such that the putter is face balanced. Preferably, the height of the lower shaft portion H is less than the height that makes the upper shaft portion shaft axis $USP_{SA}$ intersect the axis including the face center 515 and the center of gravity CG of the putter such that the putter is not face balanced and the putter has toe droop.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, sightlines can be made into other forms such as flowers or other objects and still provide the benefits of the present invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

Other than in the operating examples, or unless otherwise expressly specified, all of the numerical ranges, amounts, values, and percentages may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A putter comprising:

a putter body having a striking face member, an upper surface behind the striking face member that is visible to player when in the address position, and a sole plate that is coupled to a bottom surface of the body, wherein the body comprises at least one aperture on the upper surface and the sole plate includes a plurality of sightlines that project upward from the sole plate through the aperture and are visible to the player in the address position through the aperture;

wherein the body is comprised of a plurality of spaced apart body portions extending rearward from a back surface of the striking face member and the aperture extends between the spaced apart body portions; and wherein the sole plate includes at least two sightlines that are spaced apart by about 0.5 inches to 2.0 inches, wherein one of the sightlines is on a toe side of the putter and another sightline is on a heel side of the putter.

2. The putter of claim 1, wherein the putter upper surface includes a bore for receiving a shaft and the bore is on the heel side of the putter.

3. The putter of claim 2, wherein the bore has a bore axis that, when extending inward from the upper surface, is angled from a vertical plane in the front-to-back direction by about 10 to 15 degrees and is angled from a vertical plane in a heel-to-toe direction by about 2 to 5 degrees.

4. A putter comprising: a face member defining a striking face and having an upper surface, a toe side sightline and a heel side sightline and a bore for receiving a shaft, wherein the shaft is configured to have a lower portion with a lower portion shaft axis and an upper portion configured to have an upper portion shaft axis, wherein the lower portion shaft axis extends in a forward direction from the upper surface and in a heelward direction from the upper surface and the upper portion shaft axis extends in a heelward direction wherein the lower portion shaft axis extends in a forward direction from the upper surface at an angle of between 10 and 15 degrees from a vertical plane and in a heelward direction from the upper surface at an angle of between 2 and 5 degrees from a vertical plane and the shaft lower portion and the heel side sightline align when the putter is in the address position.

5. The putter of claim 4 further comprising:

a putter body having an upper surface behind the striking face that is visible to player when in the address position and a bottom surface that is not visible to player when in the address position, and a sole plate that is coupled to the bottom surface of the putter body by a plurality of fasteners, wherein the putter body comprises at least one aperture on the upper surface and the sole plate includes the toe side sightline and the heel side sightline that project upward from the sole plate through the aperture and are visible to the player in the address position through the aperture.

6. The putter of claim 5, wherein weight members are positioned in toe and heel areas of the sole plate to increase the putter's moment of inertia.

7. The putter of claim 6, wherein the weight members are formed of tungsten and the weight members weigh 20 to 50 grams each.

* * * * *